US006663236B2

(12) United States Patent
Sharma

(10) Patent No.: US 6,663,236 B2
(45) Date of Patent: Dec. 16, 2003

(54) INK JET PRINTING WITH COLOR-BALANCED INK DROPS MIXED USING COLORLESS INK

(75) Inventor: Ravi Sharma, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 216 days.

(21) Appl. No.: 09/999,406

(22) Filed: Oct. 31, 2001

(65) Prior Publication Data

US 2003/0082302 A1 May 1, 2003

(51) Int. Cl.[7] ..... B41J 2/21
(52) U.S. Cl. ..... 347/98
(58) Field of Search ..... 347/43, 15, 98, 347/100, 21

(56) References Cited

U.S. PATENT DOCUMENTS 4,382,262 A 5/1983 Savit
4,614,953 A 9/1986 Lapeyre
5,606,351 A 2/1997 Hawkins
5,777,636 A * 7/1998 Naganuma et al. ..... 347/10
6,055,004 A 4/2000 Fassler et al.
6,097,406 A 8/2000 Lubinsky et al.

* cited by examiner

*Primary Examiner*—Lamson Nguyen
(74) *Attorney, Agent, or Firm*—Milton S. Sales

(57) ABSTRACT

A drop-on-demand ink jet printing system includes a print head having at least one mixing chamber having a nozzle opening. A plurality of sources of color liquid ink and a source of colorless liquid ink communicate with the mixing chamber. A flow controller is adapted to selectably meter ink from the sources to the mixing chamber, whereby ink droplets of selectable color are prepared in the mixing chamber for delivery from the nozzle. The flow controller is further adapted to meter colorless ink into the mixing chamber after a droplet is delivered from the nozzle opening to thereby dilute color ink remaining in the mixing chamber sufficiently such that a next desired color can be attained by adding ink of appropriate color to the mixing chamber. The mixing chamber may be flushed with colorless ink after a droplet is delivered from the nozzle opening and before adding ink of appropriate color to the mixing chamber to attain a next desired color. The flushed ink may be bleached before being returning to the source of colorless ink. The flushed ink may be converted to black by addition of appropriate amounts of color ink before being returning to a source of black ink.

19 Claims, 4 Drawing Sheets

INK JET PRINTING WITH COLOR-BALANCED INK DROPS MIXED USING COLORLESS INK

CROSS REFERENCE TO RELATED APPLICATIONS

Reference is made to commonly assigned, U.S. patent application Ser. No. 09/466,977 entitled CONTINUOUS COLOR INK JET PRINT HEAD APPARATUS AND METHOD, filed in the name of John A. Lebens on Dec. 17, 1999.

FIELD OF THE INVENTION

This invention relates generally to ink jet printing and, more particularly, to methods and apparatus for generating color balanced ink drops in a drop on demand ink jet printer.

BACKGROUND OF THE INVENTION

Ink jet printing is a prominent contender in the digitally controlled electronic printing arena in part because of its non-impact and low-noise characteristics, its use of plain paper, and its avoidance of toner transfers and fixing. Ink jet printing mechanisms can be categorized as either continuous ink jet or drop-on-demand ink jet.

Drop-on-demand ink jet printers selectively eject droplets of ink toward a printing media to create an image. Such printers typically include a print head having an array of nozzles, each of which is supplied with ink. Each of the nozzles communicates with a chamber, which can be pressurized in response to an electrical impulse to induce the generation of an ink droplet from the outlet of the nozzle. Many such printers use piezoelectric transducers to create the momentary pressure necessary to generate an ink droplet.

Drop-on-demand printers utilizing thermally-actuated paddles have also been suggested. Each paddle would include two dissimilar metals and a heating element connected thereto. When an electrical pulse is conducted to the heating element, the difference in the coefficient of expansion between the two dissimilar metals causes them to momentarily curl in much the same action as a bimetallic thermometer, only much quicker. A paddle is attached to the dissimilar metals to convert momentary curling action of these metals into a compressive wave that effectively ejects a droplet of ink out of the nozzle outlet.

Printing images in a plurality of colors is highly desirable. This has been effected by means of a plurality of streams of ink droplets emitted from a plurality of nozzles. However, the images produced in this way are in general binary in the sense that the number of colors available for each drop is limited to that of the number of associated ink reservoirs and nozzle sets.

Commonly assigned U.S. Pat. No. 5,606,351, which issued to Gilbert A. Hawkins on Feb. 25, 1997, discloses a system having the ability to control the intensity of color droplets by mixing two or more fluid ink components (dyes, pigments, etc.) drawn into a chamber from refill channels. As such, each ink ejector squirts an ink of a particular color of varying intensity and is not capable of altering the color. That is, only the tone of the color is altered.

Commonly assigned U.S. Pat. No. 6,097,406, which issued to Anthony A. Lubinsky et al. on Aug. 1, 2000, discloses an apparatus for mixing and ejecting mixed colorant drops. A mixing chamber receives the appropriate amounts of primary colors and a drop is ejected. However, a residual amount of dye is left in the chamber and needs to be removed by flushing with a clear cleaning fluid before the next color is prepared. A separate diluent chamber is used to control color density.

Commonly assigned, co-pending U.S. patent application Ser. No. 09/466,977 entitled CONTINUOUS COLOR INK JET PRINT HEAD APPARATUS AND METHOD, filed in the name of John A. Lebens on Dec. 17, 1999, discloses a scheme for color mixing in a continuous ink jet print head. By selectively restricting flow of two or more different color inks to a nozzle, a range of colored inks can be ejected from the nozzle.

U.S. Pat. No. 4,614,953, which issued to James M. Lapeyre on Sep. 30, 1986, discloses a color inkjet printing mechanism in which real time color mixing is achieved in a single channel. The method is said to be applicable to either drop-on-demand or continuous stream inkjet printer heads. According to the Lapeyre patent, the relative sizes of a mixing chamber line and its subsequent drive chamber mixed ink drive interior are such that a continuous flow of in is maintained without significant mixing or blurring of different colors sequentially provided within the ink flow.

U.S. Pat. No. 4,382,262, which issued to Joseph Savit on May 3, 1983, discloses a method for ink jet printing in which a first dye component is printed on a receiver. One of several complementary dye components is selectively provided by dedicated nozzles, thereby producing a selected color.

Commonly assigned U.S. Pat. No. 6,055,004, which issued to Werner Fassler et al. on Apr. 25, 2000, discloses a microfluidic printing array print head. Micropumps are used to deliver various colors into a nozzle area to create a drop of desired color. The colored drop is then transferred to a receiver by contact. A shutter plate is used to control ink flow.

DISCLOSURE OF THE INVENTION

According to a feature of the present invention, a drop-on-demand ink jet printing system includes a print head having at least one mixing chamber having a nozzle opening. A plurality of sources of color liquid ink and a source of colorless liquid ink communicate with the mixing chamber. A flow controller is adapted to selectably meter ink from the sources to the mixing chamber, whereby ink droplets of selectable color are prepared in the mixing chamber for delivery from the nozzle. The flow controller is further adapted to meter colorless ink into the mixing chamber after a droplet is delivered from the nozzle opening to thereby dilute color ink remaining in the mixing chamber sufficiently such that a next desired color can be attained by adding ink of appropriate color to the mixing chamber.

According to one preferred embodiment of the present invention, the mixing chamber is flushed with colorless ink after a droplet is delivered from the nozzle opening and before adding ink of appropriate color to the mixing chamber to attain a next desired color.

According to another preferred embodiment of the present invention, the flushed ink is bleached before being returning to the source of colorless ink.

According to yet another preferred embodiment of the present invention, flushed ink is converted to black by addition of appropriate amounts of color ink before being returning to a source of black ink.

Advantages associated with the present invention include the ability to produce continuous tone images without the associated need to print with smaller drops to avoid image pixels being filled by only one drop. For example, the image pixel of a 300 dpi printer is approximately 84 micron square, requiring a 60 micron diameter drop for a spread factor of two when the drop impacts paper. The nozzle diameter may therefore be close to 60 microns. Such large nozzles are less likely to clog and therefore are more robust. Furthermore, large nozzles are easily cleaned. Large nozzles may also employ more viscous inks putting less demand on ink formulation.

The method of controlling color by adding dye and bleach provides a unique means of obtaining color balance on demand. This method allows single drop per image pixel printing with any color of choice color with many levels of intensity.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
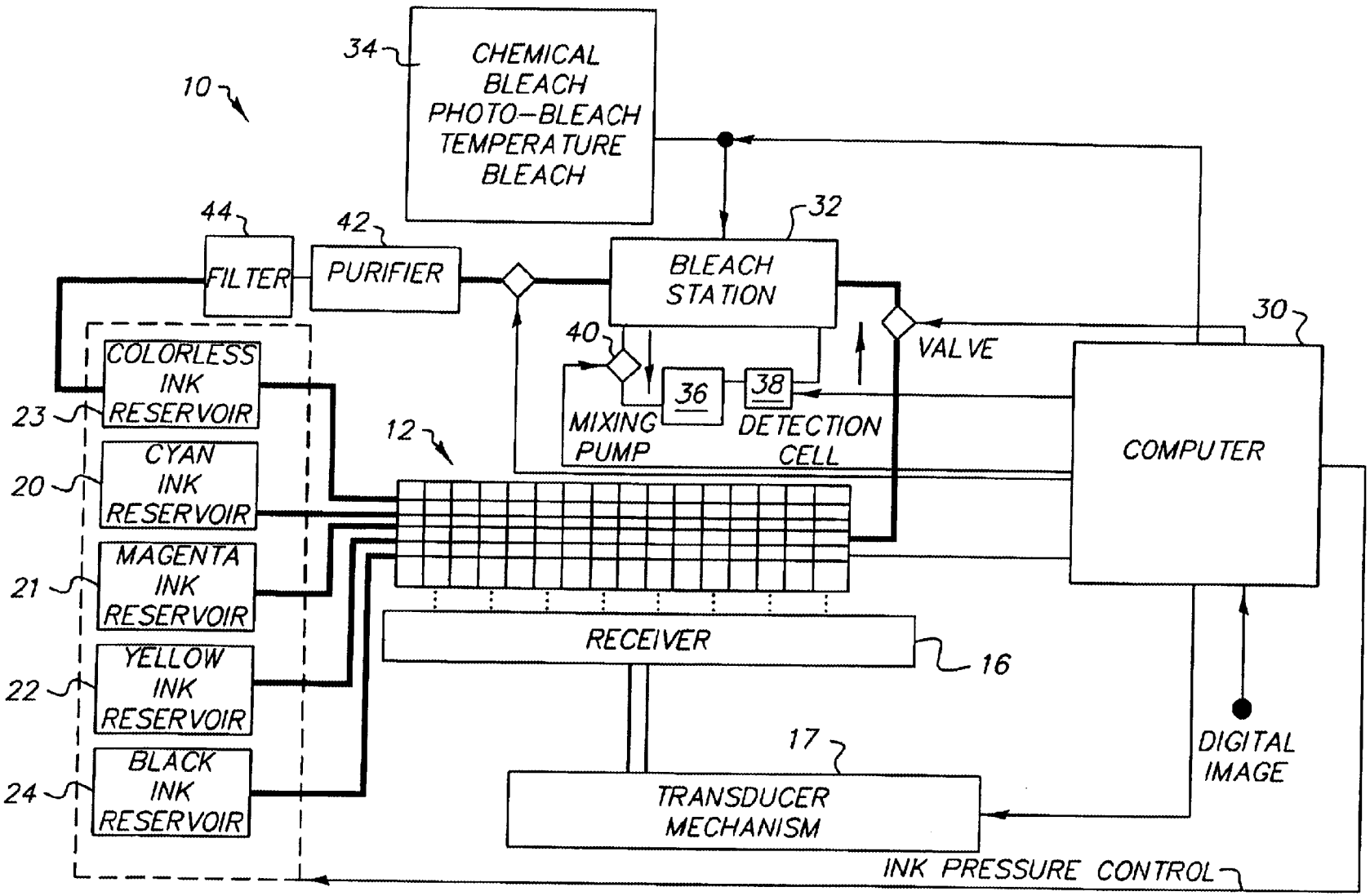
FIG. 1 is a schematic view of an ink jet printer according to a preferred embodiment of the present invention wherein flushed liquid is treated by bleaching to a colorless ink.
Figure 2:
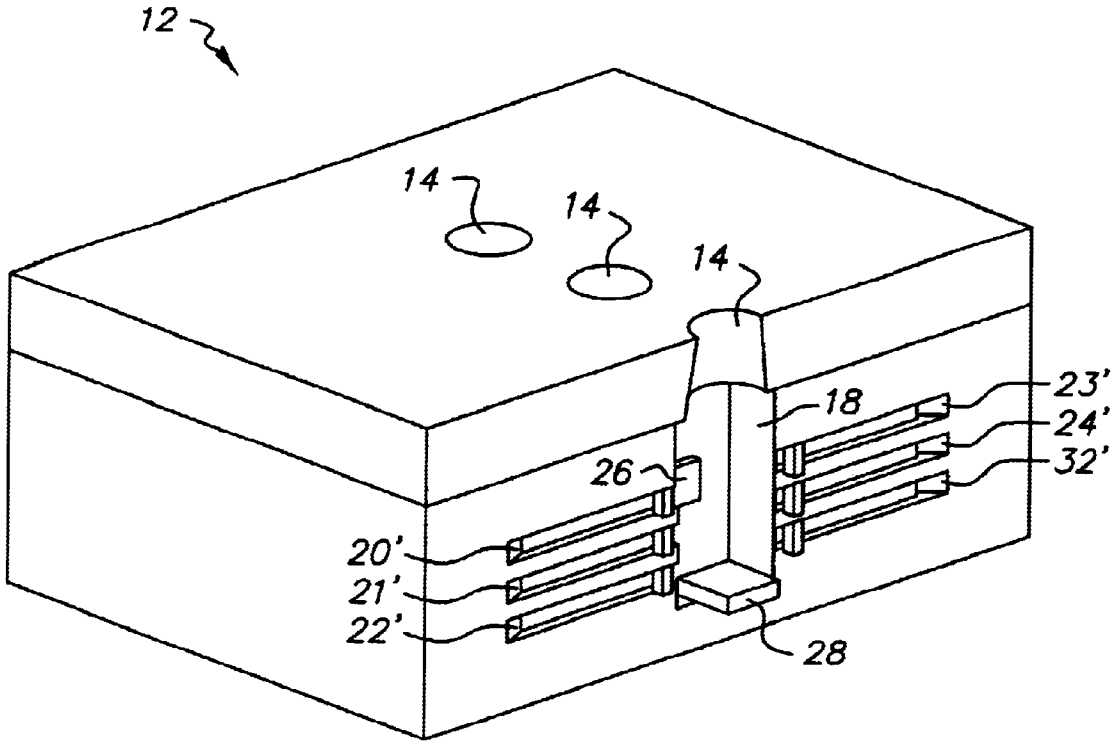
FIG. 2 is a perspective view of a print head suitable for use in the printer of FIG. 1.

Referring to FIGS. 1 and 2, an ink jet printer 10 uses a drop-on-demand print head 12 having a plurality of nozzle openings 14 in FIG. 2 for delivering ink drops of varying color to a receiver 16 moved relative to print head 12 by a computer-controlled transducer 17. Each nozzle opening 14 is in communication with an ink mixing chamber 18 which receives selected quantities of cyan (C), magenta (M), yellow (Y), and colorless dye solutions from respective reservoirs 20–23 via passages 20'–23', respectively, to create an appropriate color for an ink drop to be delivered at an image pixel being addressed. Optionally, black (K) dye solution may also be received in mixing chamber 18 from a reservoir 24 via passage 24'. The reservoirs may be pressurized so that flow occurs once a valve, not shown, is opened. Alternatively, a pump may be used to deliver liquid from the reservoirs to the mixing chamber.

A color mixture corresponding to the color to be deposited on an image pixel is prepared by metering in the appropriate amount of dyes, colorless ink and bleach. A mixer 26 is optionally provided in mixing chamber 18. Any device that causes a disturbance in the liquid present in the mixing chamber would function as a mixer. For example, mixer 26 may be a heater, piezoelectric transducer, micropump, thermally actuated flipper, piezoelectrically-driven flipper, or electrostatically driven vibrating plate. Once the color inks are mixed, an ink drop is ejected by an ink drop ejector 28. The ink ejector provided in mixing chamber 18 may be a resistor layer, such as TaAl, deposited of the floor of the mixing chamber. The resistive layer may be coated with an electrical passivation layer (e.g., SiNi and/or SiC) and also with a nonwetting passivation layer. When current is passed through the resistive layer, mixed ink is rapidly heated, causing an expanding gas bubble to eject a drop of mixed ink. Another type of ink ejector may be thermally-driven such as a bimetallic flipper paddle that bends toward nozzle opening 14 when energized with electricity. Heat released by the energized resistive strip causes differential expansion of one of the metallic layers in the bimetallic strip, causing the bimetallic paddle to flip rapidly and eject a drop of the mixed ink.

If the next image pixel to be addressed requires a different color, requiring a lower intensity of one of the constituent colors, an appropriate amount of colorless ink is added to sufficiently dilute that one constituent color. Dyes of the other constituent colors are added as needed to attain desired levels. If the image pixel to be addressed requires a color in which more than one of the constituent colors are of lower intensity, then sufficient colorless ink is added from reservoir 23 to obtain the lowest intensity color, followed by make-up dye solution to adjust the intensity of the other constituent colors.

If the just-mentioned solution for color correction is not possible due to volume constraints as determined such as by a computer 30 that controls the printing operation, then the computer commands that mixing chamber 18 be flushed with colorless ink before CMY color dyes are added according to image requirement. The ink flushed is collected via a passage 32' in a bleach station 32 where it is to be treated and converted to colorless ink by adding appropriate amounts of chemical bleach and colorless ink. Other bleaching methods such as thermal bleaching and photobleaching may be appropriate in particular circumstances. The bleach station is equipped with a bleach source 34, a mixing pump 36, a detector (dye and viscosity sensor) 38 and appropriate valves 40 to generate colorless ink, which is then cycled to colorless ink reservoir 23 for future use. A purifier 42 such as a bead pack may be used to remove breakdown products created by the bleaching process. The bleached and purified liquid may also be filtered at 44 before being returned to the colorless ink reservoir.

If the next image pixel to be addressed requires only more intense color or colors, appropriate dye is simply added to mixing chamber 18. Colorless ink may also be added to restore optimum volume and to maintain ink viscosity in the mixing chamber.

Black color may be prepared by combining CMY colors. Alternatively, black (K) ink may be provided. When black ink is prepared in mixing chamber or supplied to mixing chamber, color bleaching may not be necessary because the black dye would overwhelm any residual ink left in mixing chamber.

Fluid flow control throughout the system may be effected by microvalves and micropumps. Any of many microvalves disclosed in the literature may be used in systems according to the present invention. For example, a bimetallically driven diaphram is disclosed in Understanding Microvalve Technology, 26 Sensors, September 1994. Other types of microvalves are disclosed in U.S. Pat. Nos. 5,178,190; 5,238,223; 5,259,757; 5,367,878; 5,400,824; and 5,880,752. Any of many micropumps disclosed in the literature may be used with the present invention, as for example, electroosmotic pumps, acoustic pumps, or piezoelectrically driven membrane pumps.

Figure 3:
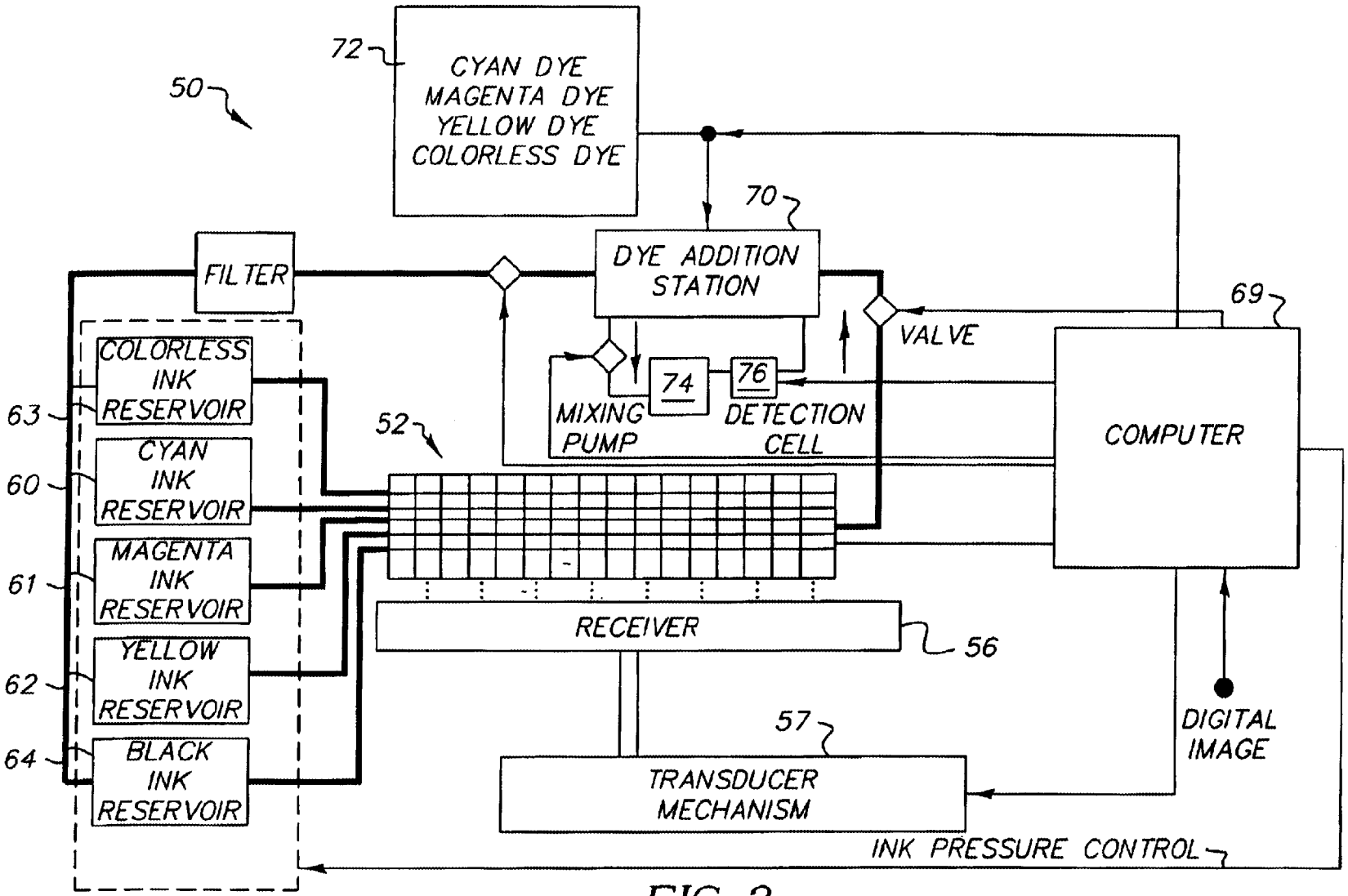
FIG. 3 is a schematic view of an ink jet printer according to a second preferred embodiment of the present invention wherein flushed liquid is treated by adding CMY and colorless ink and returned as black ink.
Figure 4:
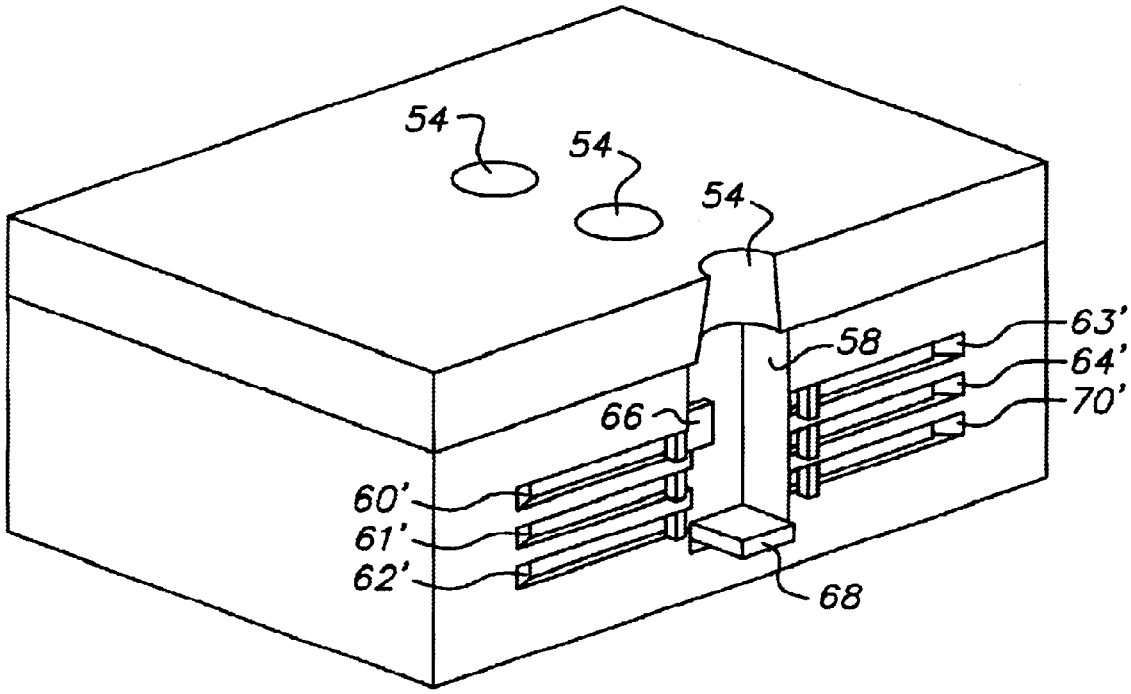
FIG. 4 is a perspective view of a print head suitable for use in the printer of FIG. 3.

In the embodiment illustrated in FIG. 1, the flushed fluid is converted to colorless ink. Referring to FIGS. 3 and 4, another embodiment of present invention is illustrated wherein the flushed fluid is converted to black ink. An ink jet printer 50 uses a drop-on-demand print head 52 having a plurality of nozzle openings 54 in FIG. 5 for delivering ink drops of varying color to a receiver 56 moved relative to print head 52 by a computer-controlled transducer 57. Each nozzle opening 54 is in communication with an ink mixing chamber 58 which receives selected quantities of cyan, magenta, yellow, colorless, and black dye solutions from respective reservoirs 60–64 via passages 60'–64', respectively, to create an appropriate color for an ink drop to be delivered at an image pixel being addressed. As in the first-illustrated embodiment, the reservoirs may be pressurized so that flow occurs once a valve is opened or, a pump may be used to deliver liquid from the reservoirs to the mixing chamber.

A color mixture corresponding to the color to be deposited on an image pixel is prepared by metering in the appropriate amount of dyes and colorless ink. A mixer 66 is optionally provided in mixing chamber 58. Once the color inks are mixed, an ink drop is ejected by an ejector 68.

If the next image pixel to be addressed requires a different color, requiring a lower intensity of one of the constituent colors, an appropriate amount of colorless ink is added to sufficiently dilute that one constituent color. Dyes of the other constituent colors are added as needed to attain desired levels. If the image pixel to be addressed requires a color in which more than one of the constituent colors are of lower intensity, then sufficient colorless ink is added from reservoir 63 to obtain the lowest intensity color, followed by make-up dye solution to adjust the intensity of the other constituent colors.

If the next image pixel to be addressed requires only more intense color or colors, appropriate dye is simply added to mixing chamber 58. Colorless ink may also be added to restore optimum volume and to maintain ink viscosity in the mixing chamber.

If the just-mentioned solution for color correction is not possible due to volume, then a computer 69 commands that mixing chamber 58 be flushed with colorless ink before CMYK color dyes are added according to image requirement. The ink flushed via a passage 70' is collected in a dye addition station 70 where it is to be treated and converted to black ink by adding appropriate amounts of CMY dye and colorless ink from a source 72. The dye addition station is equipped with a mixing pump 74, a detector (dye and viscosity sensor) 76 and appropriate valves to generate black ink, which is then cycled to black ink reservoir 64 for future use. A filter 78 may be used to clean up the recycled ink. Colorless ink is added at the dye mixing station to maintain ink viscosity.

Examples of colorants which may be mixed to form ink may be one of many found in the literature. For example, a colored ink may be formed by mixing acid blue 6 (cyan), basic red 29 (magenta) and Zeneca yellow 132 (yellow). A bleach that may be used to reduce or eliminate color is a 5% solution of sodium hypochlorite. Other bleaches that may be used include acids, bases, ozone, hydrogen peroxide, and nucleophiles.

The invention has been described in detail with particular reference to preferred embodiments thereof, but it will be understood that variations and modifications can be effected within the spirit and scope of the invention.

What is claimed is:

1. A drop-on-demand ink jet printing system for delivering droplets of selectable-color ink to a receiver; the system comprising:

a print head having at least one mixing chamber;

a nozzle opening associated with each of the at least one mixing chamber through which nozzle opening ink droplets are delivered from the associated mixing chamber to the receiver;

a plurality of sources of color liquid ink, each source (1) containing liquid ink of a different color and (2) communicating with the at least one mixing chamber;

a source of colorless liquid ink communicating with the at least one mixing chamber; and a flow controller adapted to selectably meter ink from said sources to the at least one mixing chamber, whereby ink droplets of selectable color are prepared in the least one mixing chamber for delivery from the nozzle opening to the receiver, the flow controller being further adapted to meter colorless ink into the mixing chamber after a droplet is delivered from the nozzle opening to thereby dilute color ink remaining in the mixing chamber sufficiently such that a next desired color can be attained by adding ink of appropriate color to the mixing chamber.

2. An ink jet printing system as defined in claim 1 further comprising an ejector associated with each of said mixing chambers, the ejector being adapted to cause an ink droplet to be expelled from the mixing chamber through the nozzle opening.

3. An ink jet printing system as defined in claim 2 wherein the ejector is a thermally-driven flipper paddle.

4. An ink jet printing system as defined in claim 1 further comprising a mixer associated with each of said mixing chambers to induce a disturbance in the liquid ink present in the mixing chamber.

5. An ink jet printing system as defined in claim 4 wherein the mixer is a heater.

6. An ink jet printing system as defined in claim 4 wherein the mixer is a piezoelectric transducer.

7. An ink jet printing system as defined in claim 4 wherein the mixer is a micropump.

8. An ink jet printing system as defined in claim 4 wherein the mixer is a flipper that is thermally actuated.

9. An ink jet printing system as defined in claim 4 wherein the mixer is an electrostatically driven vibrating plate.

10. An ink jet printing system as defined in claim 1 wherein the characteristic of the ink which differs is color.

11. An ink jet printing system as defined in claim 1 wherein the ink flow controller comprises a pressurized source and a valve.

12. An ink jet printing system as defined in claim 1 wherein the ink flow controller comprises a pump.

13. An ink jet printing system as defined in claim 1 further comprising apparatus adapted to flush the at least one mixing chamber with colorless ink after a droplet is delivered from the nozzle opening and before adding ink of appropriate color to the mixing chamber to attain a next desired color.

14. A drop-on-demand ink jet printing system as defined in claim 13 further comprising apparatus adapted to bleach flushed ink before returning it to the source of colorless ink.

15. A drop-on-demand ink jet printing system as defined in claim 13 further comprising:

a source of black ink; and apparatus adapted to convert flushed ink to black by addition of appropriate amounts of color ink before returning it to the source of black ink.

16. A process for delivering droplets of selectable-color ink to a receiver from a print head having at least one mixing chamber and nozzle group; the process comprising:

communicating a plurality of liquid inks of a different color with the at least one mixing chamber;

communicating a colorless liquid ink with the at least one mixing chamber; and preparing ink droplets of selectable color by selectably metering different color inks to the at least one mixing chamber;

delivering the ink droplets of selectable color from the nozzle opening to the receiver; and metering colorless ink into the mixing chamber after a droplet is delivered from the nozzle opening to thereby dilute color ink remaining in the mixing chamber sufficiently such that a next desired color can be attained by adding ink of appropriate color to the mixing chamber.

17. A process as defined in claim 16 further comprising the step of flushing the at least one mixing chamber with colorless ink after a droplet is delivered from the nozzle opening and before adding ink of appropriate color to the mixing chamber to attain a next desired color.

18. A process as defined in claim 16 further comprising the steps of:

bleaching flushed ink; and returning bleached flushed ink to the source of colorless ink.

19. A process as defined in claim 16 further comprising the step of:

providing a source of black ink;

converting flushed ink to black by addition of appropriate amounts of color ink; and returning converted black ink to the source of black ink.

* * * * *